United States Patent [19]

Ernst

[11] 4,357,541

[45] Nov. 2, 1982

[54] APPARATUS FOR THE TEMPORARY RECEPTION OF RADIOACTIVE WASTE

[76] Inventor: Max Ernst, Schlossstrasse 125, 3008 Bern, Switzerland

[21] Appl. No.: 165,225

[22] Filed: Jul. 1, 1980

[30] Foreign Application Priority Data

Jul. 3, 1979 [CH] Switzerland ..... 6219/79

[51] Int. Cl.[3] ..... G21F 5/00

[52] U.S. Cl. ..... 250/507.1; 250/506.1; 422/159

[58] Field of Search ..... 250/496, 497, 498, 506, 250/507, 515; 422/903; 252/301.1 W; 128/27 L

[56] References Cited

U.S. PATENT DOCUMENTS 4,149,087 4/1979 Artemiev et al. ..... 250/498

4,242,178 12/1980 Batjukov et al. ..... 250/507

FOREIGN PATENT DOCUMENTS 2457624 6/1976 Fed. Rep. of Germany ... 252/301.1 W

*Primary Examiner*—Bruce C. Anderson

*Attorney, Agent, or Firm*—Cooper, Dunham, Clark, Griffin & Moran

[57] ABSTRACT

A plurality of tubes (12, 13, 14) are arranged vertically in a closed row along a circle within a completely enclosed housing (1) provided with an inner radiation protection jacket (4). All the tubes (12, 13, 14) are connected as an assembled unit to a vertical shaft (17) which is mounted for rotation between a top plate (2) and a bottom plate (3) of the housing (1). A waste bag (18) can be inserted through an opening (8) in the top plate (2) into the tube (12) located at the time below same, into which bag radioactive waste (19) can be introduced also through the opening (8) which can be closed by a lid (9). Another opening (20) is provided in the bottom plate (3), it being located below the last tube (14) of the row in the intended direction of rotation of the unit. Thus, the bag (18) which is present in the corresponding tube (14) drops through said further opening (20) into a reception container (7) placed below it. When the unit is turned further daily by an amount equal to the angle between two adjacent tubes, sufficient time automatically elapses to permit the radioactivity of the waste in the filled bags which are no longer accessible to drop to an unobjectionable value until the bags fall into the reception container (7) and can be safely eliminated from there.

7 Claims, 7 Drawing Figures

Fig. 2.
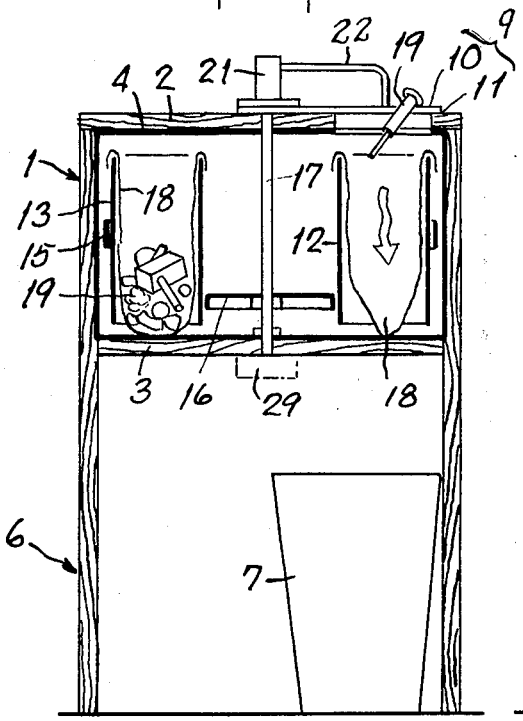
Fig. 4.
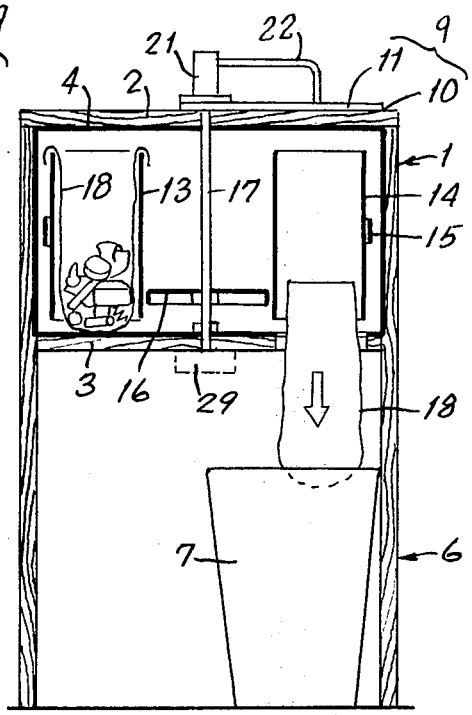
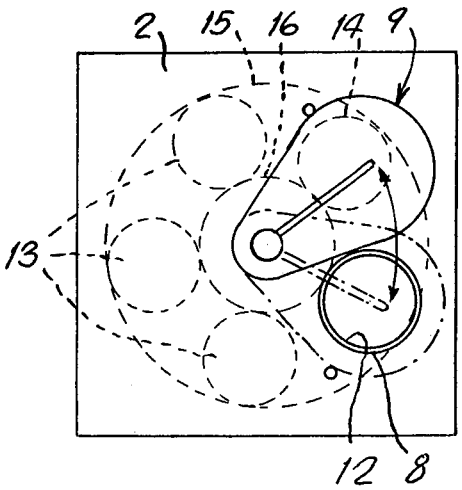
Fig. 3.
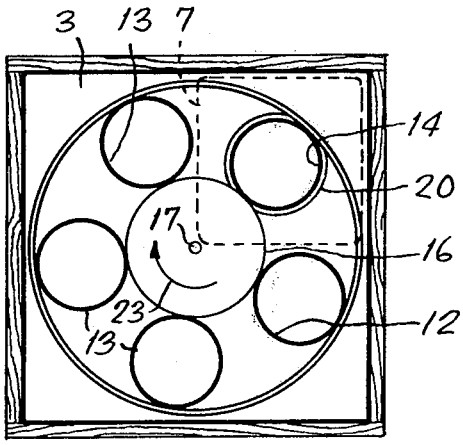
Fig. 5.

APPARATUS FOR THE TEMPORARY RECEPTION OF RADIOACTIVE WASTE

The present invention relates to an apparatus for the temporary radiation-protected reception of radioactive waste of relatively short half-life.

Radioactive isotopes which have a relatively short half-life of, for instance, a few hours are frequently used as indicators for diagnostic purposes in hospitals and other medical establishments. At present, 99m-Tc and 113-In are in particular use, in addition to 18-F, 123-I and 132-I. Such isotopes are generally administered by means of disposable hypodermics which contain a solution containing the corresponding isotopes. For reasons of environmental protection, the hypodermics used and other materials possibly employed, such as cotton pads, etc., which come into contact with the radioactive solution, may not simply be placed in ordinary rubbish; rather, they must be stored with radiation protection until the radioactivity fades to a safe level, over the period of a few days to a week.

If radiation-protected containers are set up for the radioactive wastes of the said type which are produced each day, then the waste-filled containers must be emptied each day or replaced by an empty container, and the waste which has accumulated or the filled containers must be stored in safe manner for the required decay time, with strict monitoring of the date on which the waste was produced. This is annoying and results in a considerable loss of time. Furthermore, there is the danger that, despite the monitoring, new radioactive wastes may enter into containers in which waste has already been present for a few days or that containers will be emptied prematurely into the general rubbish.

The object of the present invention is to create an apparatus for the temporary radiation-protected reception of radioactive wastes of relatively short half-life, which makes it possible, in a simple manner and without a large amount of time or space being required, to separate the periodically produced radioactive waste in accordance with the time of its origination, store it with radiation protection without further manipulation for the required period of time, and thereupon collect it for normal removal.

In order to achieve this object, the invention comprises a plurality of vertical tubes, each adapted to receive a bag. The tubes are regularly spaced about the periphery of an assembled unit which is rotatable about a central vertical axis. The assembly is in a completely enclosed housing having a radiation protection jacket. A bottom plate of the housing prevents the bags from falling out of the tubes. The bottom plate and a top cover plate of the housing are each provided with an opening corresponding to the cross-sectional area of one tube. The opening of the top plate is adapted to be closed by a radiation protection lid. A reception container for the bag is adapted to be placed below the opening of the bottom plate. The openings in the top and bottom plates are offset so that when one of the tubes in the peripheral row is below the opening of the top plate, the last tube in the direction of rotation from said one tube is above the opening in the bottom plate.

Maintenance of the apparatus of the invention is thus limited to turning the arrangement of tubes in the direction of rotation through the angle between two adjacent tubes, for instance at the end of each workday or at the start of the following workday and at the same time inserting a bag into the empty tube which now appears under the opening of the top plate. Upon this further rotation, the waste-filled bag in the tube, which is furthest away in the direction of rotation from the accessible tube, automatically drops through the opening of the bottom plate into the reception container for radioactive unobjectionable waste after it has spent the required period of time in radiation-protected position as a result of the individual daily rotations through the said angle.

One embodiment of the apparatus in accordance with the invention will be explained below with reference to the drawings, in which:

FIG. 2 is a longitudinal section through the opening in the top plate of the apparatus of FIG. 1.

FIG. 3 is a top view of the top plate.

FIG. 4 is a longitudinal section through the opening in the bottom plate of the apparatus shown in FIG. 1.

FIG. 5 is a top view of the bottom plate.

Figure 1:
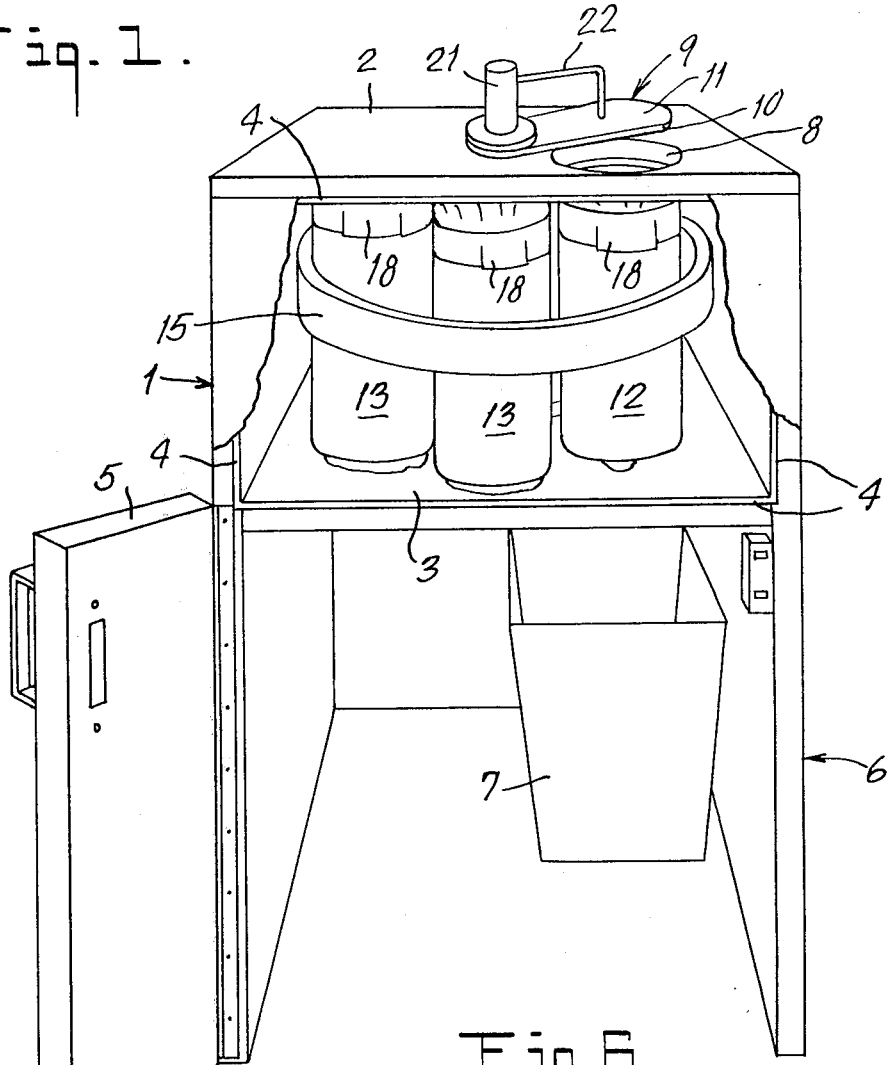
FIG. 1 is a front view of the apparatus with front wall (partially broken away) of the housing provided with a radiation protection jacket, the door of a lower part in which the reception container is arranged being shown open.

The apparatus shown in FIG. 1 has a substantially completely enclosed housing 1 whose walls, namely a top plate 2, a bottom plate 3 and four additional walls, not shown in detail, are formed, like a kitchen cabinet of wooden boards covered with plastic panels. The inner sides of all walls are covered with lead plates 4. The housing 1 stands on a base 6 which is accessible through a door 5 and within a corner of which there is a reception container 7, for instance a plastic pail. The top plate 2 is provided with a circular opening 8 into which the aforementioned radioactive waste can be thrown. The opening 8 can be closed by a swingably mounted lid 9 which consists of a metal plate 11, also provided with a lead plate 10 (best seen in FIG. 7). The range of swing of the lid 9 can be noted from FIG. 3.

As can be noted from FIGS. 1 to 5, several—in this case a total of five—metal tubes 12, 13, 14 are arranged in vertical position uniformly distributed along a circle. As shown in FIGS. 3 and 5, the tube aligned with the opening 8 in the top plate is numbered 12. The tube above the opening 20 in the bottom plate is numbered 14, and the other tubes are numbered 13. The tube lengths 12, 13, 14 are held together as an assembled unit by a strap 15 and a disk 16. The disk 16 is rigidly connected at its center with a vertical shaft 17 rotatably mounted in the top plate 2 and the bottom plate 3. As can be noted from FIGS. 2 and 4, a bag 18, preferably a plastic bag, is placed in each tube 12, 13, it being folded over the upper rim of the tubes 12, 13. In order that the bags 18 cannot normally fall out of the tubes 12, 13 which serve as holders, the bottom plate 3 is located only slightly below the lower ends of the tubes. As shown in FIGS. 2 and 3, a first tube 12 with bag 18 inserted is located directly below the opening 8 of the top plate 2, which opening can be closed by the lid 9, so that after the swinging away of the lid 9 radioactive waste, for instance hypodermics 19, can be placed into the bag 18 in the tube 12. Below the tube 14 which is last in clockwise direction from tube 12 there is provided, in the bottom plate 3, another opening 20 below which the reception container 7 is arranged. Therefore if the tube 14 is above the opening 20, the bag 18 which has been inserted into the tube drops under the weight of the waste contained in it through the opening 18 into the reception container 7 (FIG. 4).

The shaft 17 extends beyond the top plate 2 and bears, above a bushing 21 and a handle 22, the metal plate 11 of the lid 9, which metal plate is provided with the lead plate 10.

The manner of operation of the apparatus shown is as follows: The medical personnel use the apparatus for the disposal of radioactive waste of the aforementioned type by swinging the lid 9 away from the opening 8, throwing the waste into the bag 18 which is held below the opening 8 and then again swinging the lid 9 over the opening 8. Nothing else need be done by the medical personnel.

At the end or the beginning of each workday a worker turns the unit including tubes 12, 13, 14 in clockwise direction as indicated by an arrow 23 in FIG. 5 around the axis of the shaft 17 until the next tube 14 which is empty in accordance with FIG. 4 appears below the opening 8 (FIGS. 1 and 3). Thereupon, the worker places an empty bag 18 into the empty tube so that a fresh bag is available for the day's waste. Upon the turning of the unit 12, 13, 14, the adjacent tube, as seen in counterclockwise direction, comes above the opening 20 of the bottom plate 3 and drops into the receiving container 7. Since several rotations through the angular distance between two adjacent tubes have been effected between the position of the corresponding bag below the disposal opening 8 of the top plate 2 and over the ejection opening 20 of the bottom plate 3, i.e., several days have passed, the radioactivity of the waste in the bag in question has dropped to an unobjectionable value so that it can be stored directly in the unprotected reception container 7 and when necessary taken away and destroyed.

The number of tubes 12, 13, 14 arranged uniformly about the shaft 17 depends, of course, when one bag is inserted each day, on the length of the required decay time for the radioactivity of the waste. In the present example it is assumed that this time is three days so that a total of five tubes are provided and the time of stay of the radioactive waste in the housing 1 is at least three and a half days. Days on which the apparatus is not used need not be considered. On such days, the arrangement of tubes is not turned nor a fresh bag inserted, so the time of stay of the filled bags is merely increased. Even if the error, or in the case of a slightly filled bag, the assembly of tubes is not turned further after the end of a day, no disadvantageous consequences occur since, in any event, each bag must pass over the entire path between the openings 8 and 2. Furthermore, the bag present below the insertion opening 8 is screened by the protective lid 11.

Since the servicing of the present apparatus is limited to bringing the next tube length once a day below the opening and inserting an empty bag into it, the embodiment described with reference to FIGS. 1 to 5 is, in general, entirely satisfactory. In order to make unintended turning of the arrangement of the tube lengths difficult, the shaft 17 can be provided with frictional braking action in the top plate 2 and the bottom plate 3.

Figure 6:
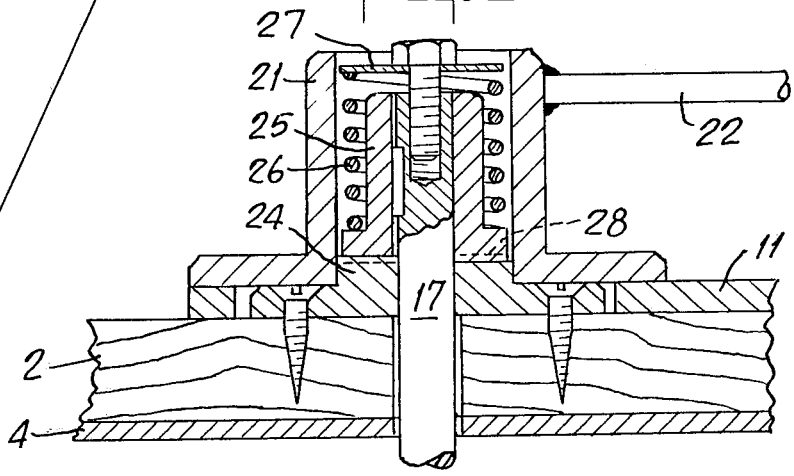
FIG. 6 is a cross-section through a locking device for the apparatus of FIG. 1.

In a somewhat more refined embodiment, a simple device can be provided which prevents the assembly of tubes 12, 13, 14 from being turned in the direction opposite the arrow 23 of FIG. 5, as a result of which inserted radioactive waste would pass into the reception container 7. Such a device, which can also hold the position of a tube length fast below the opening 8 is shown in FIG 6. The bushing 21 to which the metal plate 11 of the lid 9 and the handle 22 are fastened, is guided on a base disk 24 screwed to the top plate 2. On the base disk 24 there also lies an inner bushing 25 which is fastened to the shaft 17 in a manner fixed for rotation with it but axially displaceable and is pressed by a spring 26 against the base disk 24, the spring 26 acting against a disk 27 which abuts the head of a screw inserted in the end of the shaft 17. The facing surfaces of the base disk 27 and the inner bushing 25 are provided with locking elements 28, for instance teeth, which have merely been indicated in FIG. 6, which permit rotation of the inner bushing 25 and therefore also of the shaft 17 only in one direction of rotation with respect to the base disk 24. Furthermore, these locking elements 28 can be developed in such a manner as to provide increased resistance to turning in each case after rotation through the angle between two adjacent tubes, and therefore after rotation in each case by 72° in the case of the arrangement shown in FIGS. 1 to 5.

In order to prevent the assembly of tubes 12, 13, 14 being turned further prematurely, i.e., before the end of a day, the shaft 17 can furthermore be provided with a simple time-controlled lock 29, which has been merely indicated in FIGS. 2 and 4. In order to avoid the necessity of an electric power supply for the present apparatus, the lock 29 can be developed purely mechanically, in known manner. For this purpose, it can have a spring tensioned upon the turning of the shaft 17. This spring drives a clock mechanism, which holds a bolt in blocking position during the running down of the clock mechanism, and releases the bolt at the end of the running down time of the clock mechanism.

Figure 7:
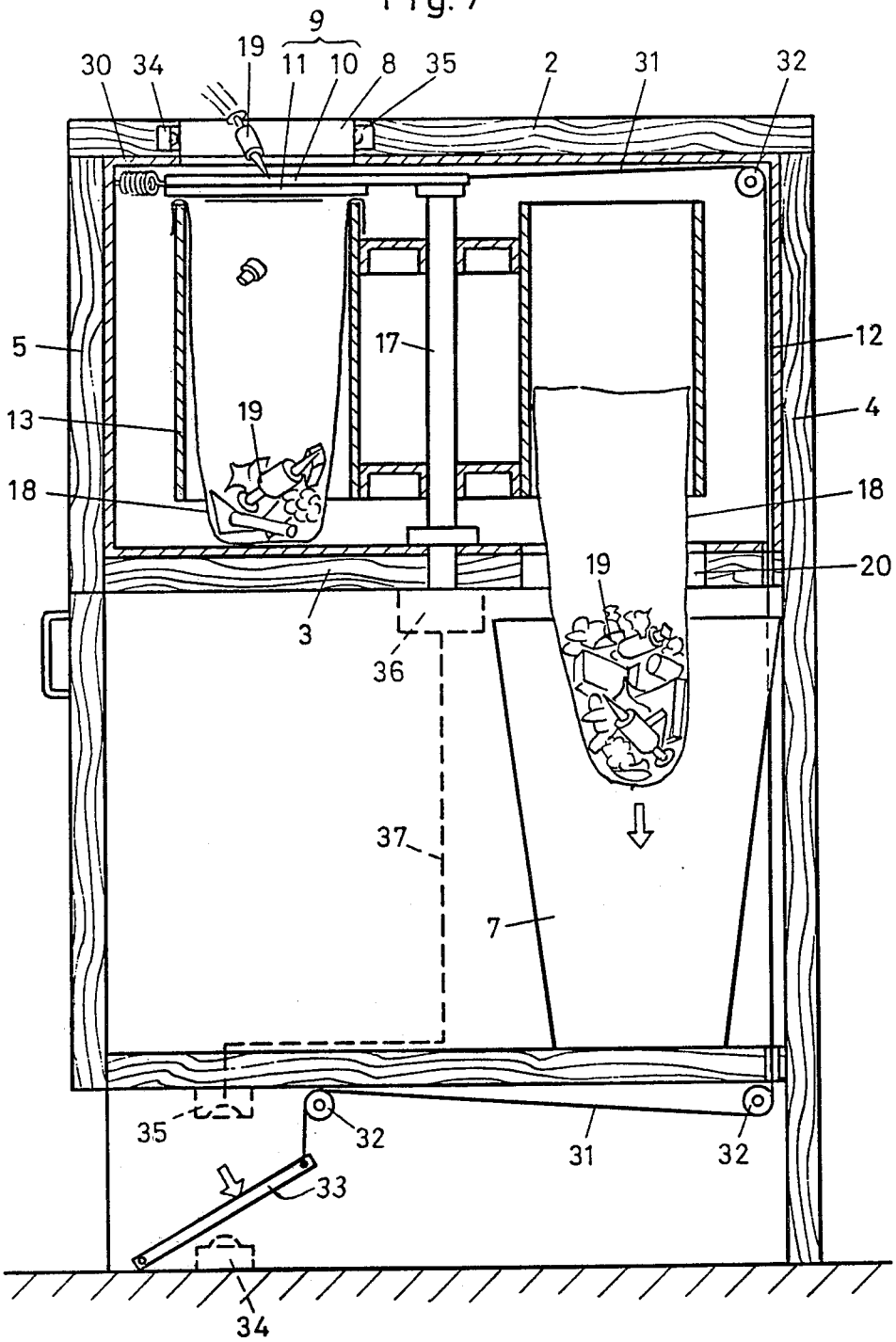
FIG. 7 is a longitudinal section through the top plate and bottom plate of another embodiment of the apparatus shown in FIG. 1.

In the variant of the invention shown in FIG. 7, the metal plate 11 of the lid 9 which is provided with a lead plate 10 is again swingably mounted, it being held in its closed position by means of a spring 30. To the lid 9 there is fastened a rope 31 which is guided over guide rollers 32 to a foot pedal 33. By actuating the foot pedal 33, the lid 9 can be moved into its open position against the force of the spring 30. When the pedal 33 is released, the lid is moved back into the closed position by the spring 30. Such an embodiment has the advantage that contamination of the handle 22 of the lid 9 (FIGS. 2 and 4) by contact with contaminated gloves is prevented. For the insertion of radioactive waste it is merely necessary to actuate the pedal 33 without having to touch the apparatus with one's hands.

Instead of the pedal 33 there could also be provided a light barrier connected with an opening mechanism for the lid 9. FIG. 7 shows in dashed line one such light barrier which in known manner contains a source of light 34 and a light receiver 35. It can be arranged, as shown, either in the bottom of the apparatus in place of the foot pedal 33 or else above the lid 9. A drive mechanism 36, also indicated in dashed line, which is electrically connected with the light barrier 34, 35 by an electric line 37 opens the lid 9 upon interruption of the beam of light of the light barrier 34,35 and then closes it again automatically, after a given period of time.

I claim:

1. An apparatus for the temporary radiation protected reception of radioactive waste of relatively short half-life, characterized by the fact that a plurality of tubes, each adapted to receive a bag which can be inserted therein, are arranged vertically in a closed row in a completely enclosed housing provided with a radiation-protection jacket, said tubes being turnable as an assembled unit around a vertical axis and a bottom plate of the housing preventing the bags from falling out of the tubes, and by the fact that a top cover plate and the bottom plate of the housing are each provided with an opening which corresponds to the cross-sectional area of the tubes, the opening of the top plate being adapted to be closed by a radiation-protection lid while a reception container for the bags is adapted to be placed below the opening of the bottom plate, the said openings being offset with respect to each other, in the direction of rotation of the unit in such a manner that in each case the first one of the tubes lying in a row is below the opening of the top plate and the last tube in the direction of rotation is above the opening in the bottom plate.

2. An apparatus according to claim 1, characterized by the fact that the tubes are arranged in a circle and are connected with a central vertical shaft which is supported for rotation in the bottom plate and in the top plate.

3. An apparatus according to claim 2, characterized by the fact that the shaft protrudes beyond the top plate and that the radiation protection lid for the opening of the top plate is mounted swingably on the protruding part of the shaft.

4. An apparatus according to claim 2 or claim 3, characterized by the fact that the shaft is provided with a pawl device in order to prevent rotation of the unit in the opposite direction of rotation and to fix the position of the tubes with respect to the openings.

5. An apparatus according to claim 2, characterized by the fact that the shaft is provided with a time-controlled lock in order to prevent rotation of the unit before the expiration of a given period of time.

6. An apparatus according to claim 1, characterized by the fact that the radiation-protection lid is held in closed position by spring means and is connected with the one end of a rope the other end of which is connected to a foot pedal by means of which the radiation-protection lid can be moved into the open position.

7. An apparatus according to claim 1, characterized by the fact that a light barrier is arranged on the housing, the barrier being connected with a mechanism for opening and closing the radiation-protection lid.

* * * * *